United States Patent [19]

Matson

[11] Patent Number: 4,946,222

[45] Date of Patent: Aug. 7, 1990

[54] LIFT PLATFORM FOR CHAIRS

[75] Inventor: Carl G. Matson, Little Rock, Ark.

[73] Assignee: Triangle Engineering of Arkansas, Inc., Jacksonville, Ark.

[21] Appl. No.: 303,914

[22] Filed: Jan. 30, 1989

[51] Int. Cl.[5] ..... A47C 1/02

[52] U.S. Cl. ..... 297/345; 297/330; 297/DIG. 10; 297/325

[58] Field of Search ..... 297/345, DIG. 10, 337, 297/338, 330, 325, 326, 327, 347, 68, 88, 89

[56] References Cited

U.S. PATENT DOCUMENTS

| | | | |
|---|---|---|---|
| 3,138,402 | 6/1964 | Heyl, Jr. et al. . | |
| 3,147,038 | 9/1964 | Barabas . | |
| 3,596,991 | 8/1971 | Mckee . | |
| 3,640,566 | 2/1972 | Hodge . | |
| 3,851,917 | 12/1974 | Horstmann et al. . | |
| 3,881,771 | 5/1975 | Amstutz . | |
| 4,007,960 | 2/1977 | Gaffney | 297/DIG. 10 X |
| 4,637,652 | 1/1987 | Bergenwall | 297/DIG. 10 X |
| 4,752,100 | 6/1988 | Lemaire | 297/DIG. 10 X |

FOREIGN PATENT DOCUMENTS

| | | | |
|---|---|---|---|
| 77280 | 4/1983 | European Pat. Off. | 297/DIG. 10 |
| 600834 | 6/1978 | Switzerland | 297/DIG. 10 |
| 8203320 | 10/1982 | World Int. Prop. O. | 297/DIG. 10 |

*Primary Examiner*—Peter R. Brown

*Attorney, Agent, or Firm*—Emrich & Dithmar

[57] ABSTRACT

A power-assisted lift platform for a chair includes a base, a lift frame, left and right side lift linkages and an electrically powered linear actuator connected between the base and the lift frame. The chair may be mounted to the lift frame. The lift linkages are pivotally connected at their forward ends to the base and at their rear ends to the lift frame. The lift linkages are arranged so that when the actuator is extended, the lift frame and chair are raised in a generally vertical path to reduce the fore-to-aft motion of the occupant's feet from the rest or seated position. While raising the occupant, the mechanism also tilts the occupant forwardly and transfers the occupant's center of gravity forwardly, more directly over his or her ankles to provide greater stability to the occupant in alighting from or entering the chair.

7 Claims, 4 Drawing Sheets

FIG. 1
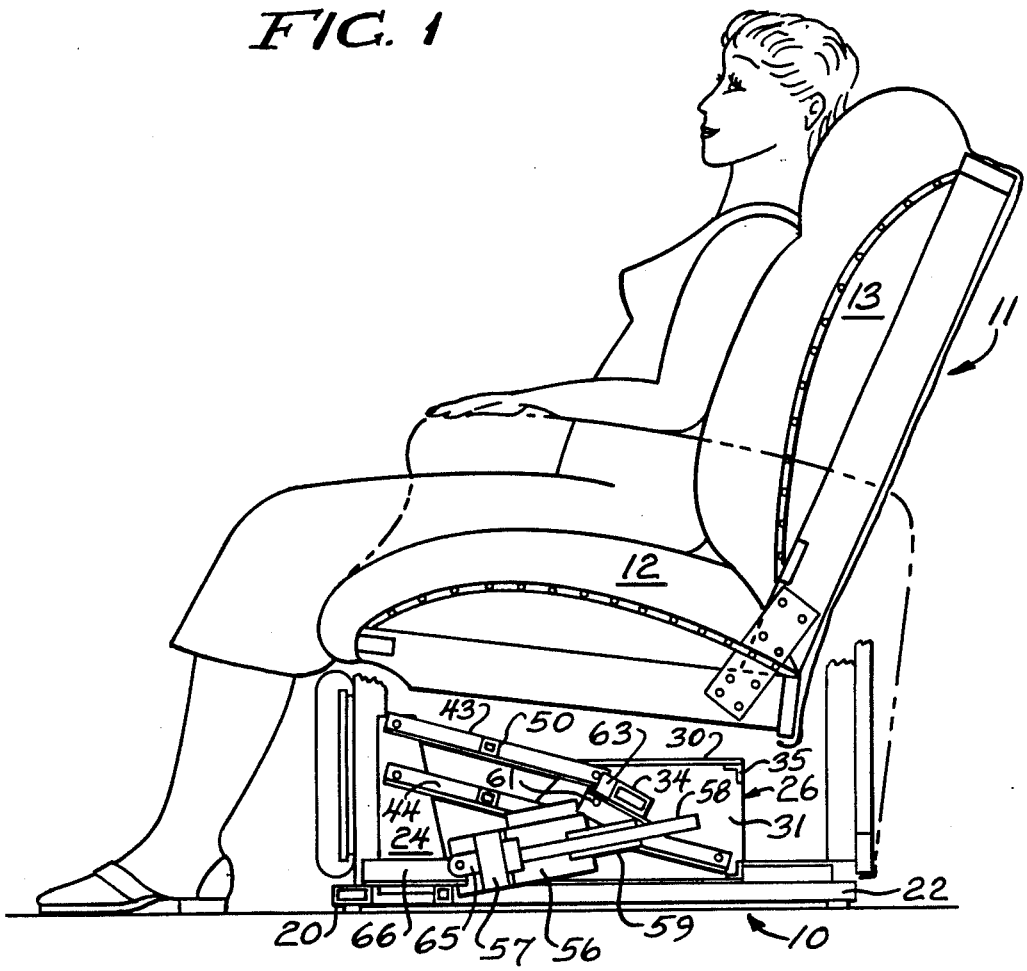
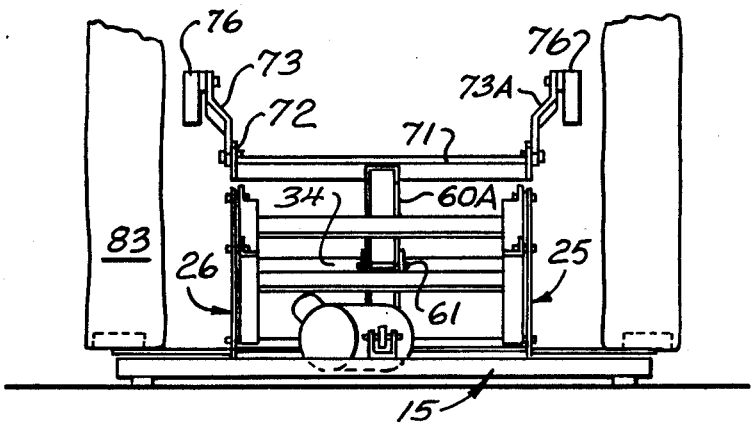
FIG. 6

LIFT PLATFORM FOR CHAIRS

FIELD OF THE INVENTION

The present invention relates to a lift platform for a chair. Chairs with power-assisted lift mechanisms are frequently used by invalids or others requiring assistance in alighting from the chair.

BACKGROUND OF THE INVENTION

In the prior art chair disclosed in Heyl, Jr. et al U.S. Pat. No. 3,138,402, a parallelogram lift linkage is actuated by rotating a bell crank against the lift links to create a movement about the pivot connection between the links and the base which rests on the floor to rotate the links to the raised position. This arrangement requires that the linkage hold the weight of the chair and occupant in cantilever from the rear of the links in the raised position. As a result of greater stress on the pivots of the linkage, this arrangement results in instability (i.e. a feeling of looseness) of the linkage on the part of the occupant at the elevated or raised position. Moreover, the seat of the chair of this patent is arranged into a forward portion which does not rise when the chair is elevated, and a rear portion which does rise and is tilted forwardly when the chair is elevated. If the seat of heyl, Jr. et al were not divided into two sections, the occupant would be forced to move his or her feet forwardly when getting out of the chair.

Another lift assist chair disclosed in the prior art Gaffney U.S. Pat. No. 4,007,960. However, the lift linkage is arranged so that it rotated about the rear of the chair base. This results in moving the occupant rearwardly when raising the chair form the normal rest position to the elevated exit position and requires the occupant to shift his or her feet relatively to the rest position in order to alight from the chair. Shifting of the feet of the occupant is considered disadvantageous, especially for severely handicapped persons or those suffering form advanced stages of arthritis.

SUMMARY OF THE INVENTION

The improved lift platform of the present invention includes a base which is adapted to rest on a floor (or any other horizontal, flat surface), an intermediate or lift frame, left and right side lift linkages and an electrically powered linear actuator. One end of the linear actuator is pivotally connected to the forward portion of the base, and the other end of the linear actuator is connected to the rear of the lift frame. The chair is mounted directly to the lift frame.

The lift linkages are pivotally connected at their forward ends to left and right side stanchions extending upwardly from the base, and they are connected at their rear ends to the lift frame. The lift linkages, when viewed from the side, extend rearwardly and downwardly from their forward connections to the base when the lift platform is in the lowered or "rest" position. Each side lift linkage includes an upper link and a lower link with the upper link being shorter than the lower link so that as the intermediate frame is raised to the exit position, the chair is tilted forwardly to assist the occupant to alight from the chair by shifting the occupant's weight forwardly from the sitting position and by placing the occupant in a better posture for transferring the occupant s weight to the feet as he or she alights from the chair in the elevated position.

Moreover, the lift linkages are constructed and arranged, by virtue of their being pivoted about a forward position on the base and by having them inclined rearwardly and downwardly in the lowered position, to raise the occupant to the exit position without causing the occupant to shift his or her feet along the floor in order to alight from the chair. That is, when the chair is in the lowered position and the occupant assumes a normal seated posture, his or her feet are located in a predetermined position relative to the base of the chair. As the lift platform is elevated, and the intermediate frame is both raised and tilted forwardly, the intermediate frame moves the occupant slightly forwardly to shift the center of gravity closer to a position above the ankles of the occupant. This action of shifting the occupant slightly forwardly while tilting the occupant during exit is considered an important feature of the present invention because lift mechanisms of this type are intended primarily to assist convalescing, invalid or handicapped persons to alight from the chair; and the arrangement of the present invention facilitates transferring the occupant from a seated position to an exit posture without having to move his or her feet. It is frequently difficult, discomforting or even painful for such a person to move his or her feet from the position they normally assume in the seated posture to one which is necessary to alight safely from the chair.

Thus, the present invention provides a mechanism which not only permits the occupant to maintain his or her feet in substantially the same position while exiting the chair as the feet assumed when the chair was lowered, but by tilting the occupant and shifting the occupant slightly forwardly, the center of gravity of the occupant is placed more directly over the ankles of the occupant to provide stability for the occupant in transferring his or her weight to the feet.

The present invention also provides greater stability than some prior chairs by arranging that the line of force exerted by the linear actuator in the raised position when viewed from the side extends between the rear pivots of the upper and lower links of each side four-bar linkage. Thus, the links are both in tension at the raised position and the actuator bears the weight of the occupant. This provides stability when the linkages are extended and avoids cantilevering the occupant and the chair frame by means of the like linkage, as is inherent in some prior art devices including the Heyl, Jr. et al device, which also places the links in a bending mode in the raised position.

Another advantage of the present invention relative to certain commercial embodiments of invalid chairs is that the lift ratio of the present mechanism is substantially constant over the full range of vertical movement. By "lift ratio" is meant the amount of vertical distance through which the occupant is moved per unit movement of the power actuator. A generally constant lift ratio is desirable because it reduces the peak torque required of the power unit during the full range of operation, and it also provides greater comfort and a feeling of stability for the occupant since his or her rate of vertical movement is generally constant when the chair is being raised or lowered.

Still another advantage of the present invention, as persons skilled in the art will appreciate from a more detailed understanding of it, is that as the lift linkages are extended to the raised position, the weight of the occupant is shifted toward the location above which the lift linkages are connected to the base, rather than away from that location as occurs in a commercially available invalid chair constructed in accordance with the teachings of the above-identified Gaffney patent. This has the advantage of affording greater mechanical stability since the amount by which the center of gravity of the occupant is displaced relative to the connection of the lift linkage to the base is reduced rather than increased, as normally would occur if the lift linkages are pivotally connected to the rear of the base.

Yet another feature of the present invention is that the same lift platform and linear actuator may be used, with a relatively minor addition, and without modification of dimensions, to tilt the chair rearwardly in the lowered position for greater comfort. In the tilt version, the same actuator may be used to control a linkage to tilt the chair rearwardly while it is in the lower position rearwardly and, simultaneously, to extend a leg rest, if desired.

Other features and advantages of the present invention will be apparent to persons skilled in the art from the following detailed description of a preferred embodiment accompanied by the attached drawing wherein identical reference numerals will refer to like parts in the various views.

BRIEF DESCRIPTION OF THE DRAWING

FIGS. 1–3 show a non-tilting chair; and FIGS. 4–6 show an embodiment wherein the chair may be tilted in the lowered position.

FIG. 1 is a left side elevational view of a chair incorporating the improved lift platform of the present invention in the lowered position, with the lower portion of the lift platform broken away;

FIG. 2 is a view similar to FIG. 1 with the chair in the raised or exit position;

FIG. 3 is a perspective view of the lift platform and actuating mechanism of FIG. 1 in the lowered position and without the chair, taken from a position above, to the left and to the rear of the lift platform;

FIG. 4 is a side view similar to FIG. 1 in which the chair is a tilt chair and the actuating mechanism has placed the chair in the tilt position;

FIG. 5 is a view similar to FIG. 4 with the lift mechanism removed and the pantograph linkage shown in the extended positions; and FIG. 6 is a front elevational view of the lift platform of FIG. 4 in the tilt position with portions of the chair broken away for clarity.

DETAILED DESCRIPTION OF THE PREFERRED EMBODIMENTS

Figure 2:
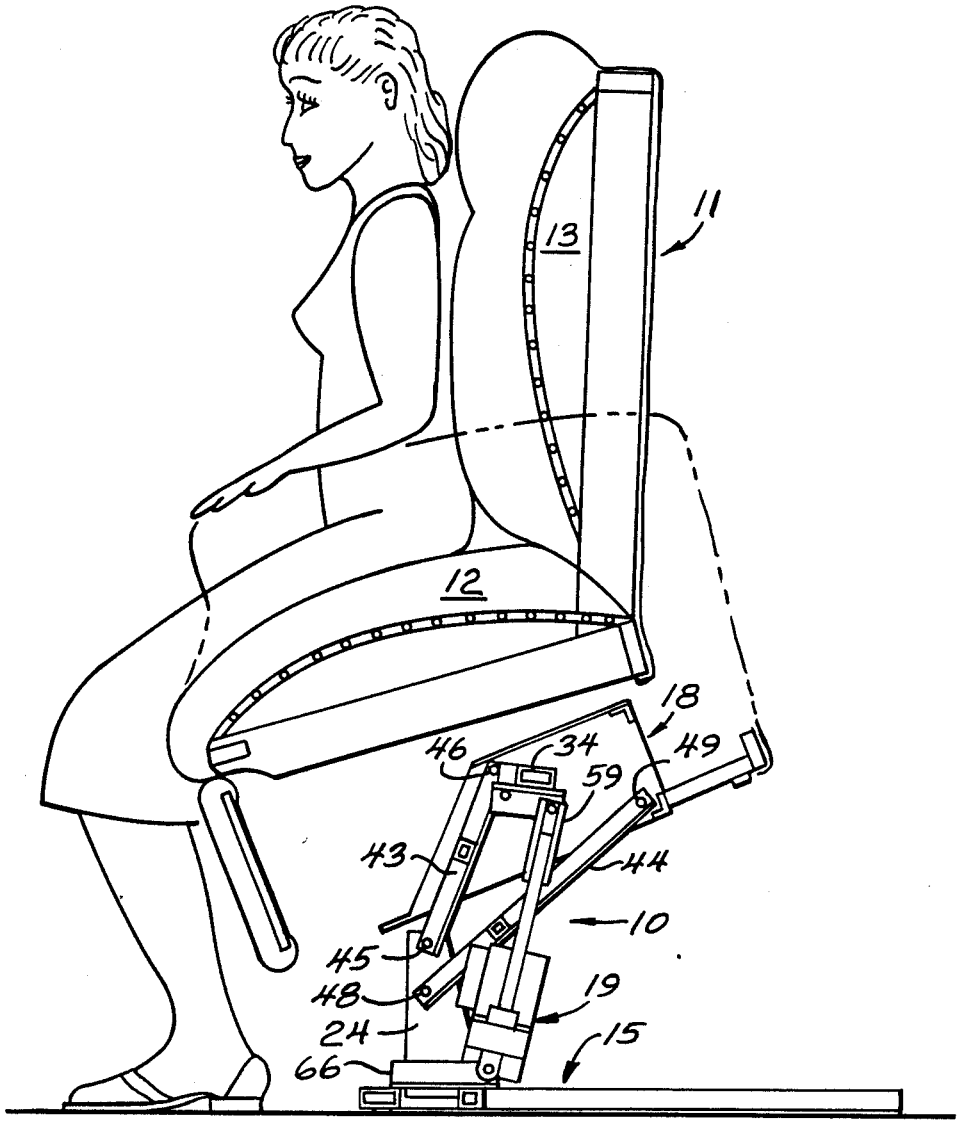
Figure 3:
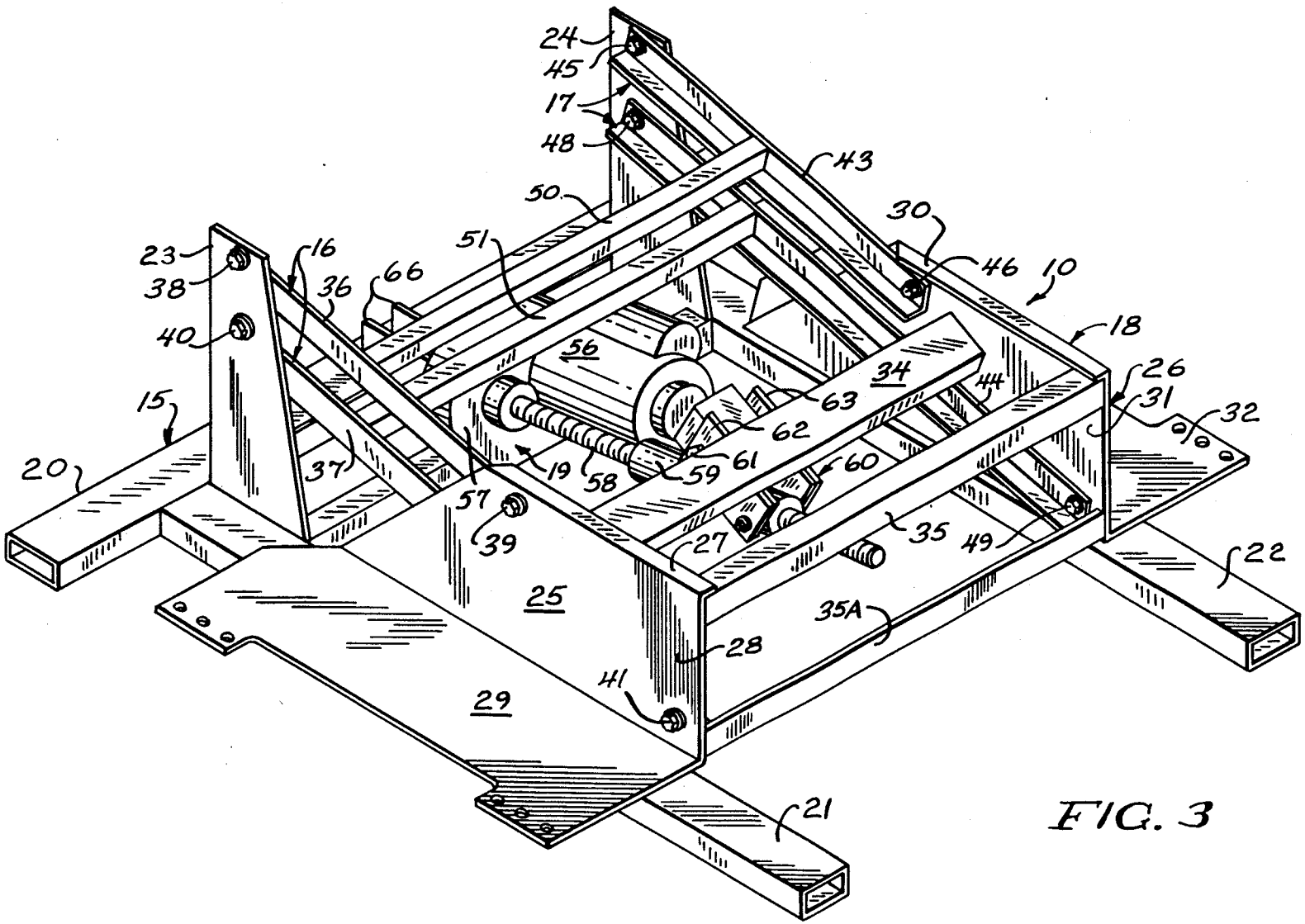

Referring first to FIGS. 1, 2 and 3, a lift platform is generally designated 10, and in this embodiment, the lift platform 10 is adapted to raise a chair generally designated 11 which is not adapted to tilt rearwardly in the lowered position shown in FIG. 1. The chair 11 includes a seat 12 and a back 13 which are rigidly connected together so that the back 13 does not move relative to the seat. Moreover, when the chair 11 is in the lowered position as seen in FIG. 1, (i.e. the "normal" or rest position as distinguished from the raised or "exit" position seen in FIG. 2), the chair is not capable of being reclined or tilted. The chair 11 and occupant are simply moved between the lowered position of FIG. 1 and the raised position of FIG. 2.

Turning now to FIG. 3, the platform 10 includes a base generally designated 15, left and right side lift linkages generally designated respectively 16 and 17, and a lift frame generally designated 18 to which the chair is mounted. The lift platform also includes a linear actuator generally designated 19 which is pivotally connected at one end to the base 15 and pivotally connected at its other end to the lift frame 18 to raise and lower the lift frame, and thus the chair. Even though the lift linkages 16, 17 are referred to as left and right side lift linkages, as will be made clear, each linkage includes an upper link and a lower link. The associated upper links are formed into a rigid "H" shape by a cross member, as are the lower links. Thus, the linkages act in unison, and are stable due to the interconnections to be described further below.

Turning now to the base 15, it includes a front transverse tubular frame member 20 to the rear surface of which are welded fore-to-aft left and right side tubular frame members 21, 22. First and second plates 23, 24 are welded to the front transverse frame member 20 and, respectively, to the forward portions of left and right side frame members 21, 22 to stiffen the base and to form uprights or stanchions near the front of the lift frame or platform 18.

The lift frame 18 includes a left side frame section generally designated 25 and a right side frame section 26 which is similar but complementary to the left side frame section 25. The left side frame section is formed from a single piece of sheet metal to provide an inwardly turned upper horizontal flange 27, a vertical frame plate 28 and an outwardly extending horizontal lift plate 29. Similarly, the right side frame section 26 includes an inwardly extending upper horizontal flange 30, a vertical frame plate 31, and an outwardly extending lower horizontal lift plate 32. A tubular stringer 34 and angle members 35, 35A are welded between the side frame sections 25, 26 to add rigidity to the lift frame. The chair 11 is mounted to the horizontal lift plates 29, 32 of the side frame section 25, 26. If the chair is a unitary, non-tilting chair and it is not a recliner, the sides of the chair may be mounted directly to the horizontal lift plates 29, 32. If the chair is of the tilt type illustrated in FIGS. 4–6 and the back and seat are separate from the arm rests, or if it is a recliner (not shown, but to which the invention may be adapted) then the back and seat may be mounted as a unit to the horizontal lift plates 29, 32. The manner in which the chair is mounted to the horizontal lift plates may be conventional.

Turning now to the lift linkages, the left side lift linkages 16 include an upper angle member 36 and a lower angle member 37. The upper angle member is connected to the upper portion of stanchion 23 by means of a pivot bolt 38, and at its rear end to the vertical plate 28 of the lift frame by means of a pivot bolt 39. Similarly, the lower angle member 37 is pivotally connected to the stanchion 23 at 40 and pivotally connected to the plate 28 at 41. Preferably, a nylon washer is inserted between each of the angle members 36, 37 and the stanchion 23 or plate 28 to prevent binding and to reduce friction.

Similarly, the right side linkage 17 includes an upper angle member 43 and a lower angle member 44. The upper angle 43 is pivotally connected at 45 to stanchion 24 and pivotally connected at 46 to the vertical plate 31 of the right side frame section 26 of the lift frame. The lower angle member 24 is pivotally connected at 48 to the stanchion 24 and at 49 to the vertical plate 26. The upper angle members 36, 43 are rigidly connected together by a tubular cross frame member 50; and the lower angle members 37, 44 are similarly rigidly connected together by a tubular cross frame member 51. Thus, the upper links and frame member 50 are formed into a rigid "H" shape, as are the lower links 37, 44 and frame member 51.

The linear actuator 19 includes an electric motor 56, a reduction gear transmission 57 and a driven screw 58. An internally threaded nut or sleeve 59 is received on the screw 58; and the nut 59 is trunnion-mounted to a forked member 60 which is mounted beneath the stringer 34. In the case where the lift platform is intended for use solely in combination with straight chairs and is not intended to tilt the chairs, the forked mounting member 60 may be welded to the bottom surface of the stringer 34. However, since the present invention preferably is intended to accommodate both non-tilting chairs and is adapted to tilt chairs as well, in the embodiment illustrated in FIG. 3, the forward portion of the forked mounting member 60 is connected by means of a pin 61 to first and second brackets 62, 63 (see FIG. 3) which are welded to the stringer 34 and extend in front of it (see FIG. 1). The reason for this will be made clear presently, although it is not necessary that the member 60 in any way rotate about the pin 61 for operation of the non-tiling embodiment of FIGS. 1–3.

Referring particularly to FIG. 1, mounted to the rear of the linear actuator 19 is a mounting tab 65 which is pivotally mounted to a pair of mounting brackets, seen in FIG. 3 and designated 66. The brackets are welded to the top of the forward frame member 20 of the base 15. Thus, the linear actuator is free to rotate about a horizontal axis at its lower, forward end; and when it is driven in one direction, the screw 58 causes the nut 59 to extend, thereby urging the lift frame 26 from the normal rest position of FIG. 1 to the raised or exit position of FIG. 2.

It will be observed that the linkages extend from a generally downwardly and rearwardly inclined direction (FIG. 1) through a horizontal position and then to an upwardly and rearwardly inclined position, as the linkage is actuated from the rest position of FIG. 1 to the raised or exit position of FIG. 2. This reduces the fore-to-aft displacement of the front of the chair form the lowered to the raised position, although the knees of the occupant are moved slightly forwardly. With this movement together with the forward tilting of the occupant and the shifting of the center of gravity of the occupant to a position more close to one directly over the ankles of the occupant, the occupant of the chair is both prepared for alighting and is so positioned without having to move his or her feet from the rest position (compare FIGS. 1 and 2). This is considered important because some commercial chairs which rotate the lift linkage from the lowered to the raised position, also move the occupant substantially in a fore-to-aft direction thereby causing the occupant to move his or her feet, and this can not only be discomforting, but in the case of a seriously handicapped or arthritic person, it can be painful or impossible. Thus, the present invention is constructed and arranged to elevate and tilt the occupant forwardly, shifting the center of gravity of the occupant forwardly and more nearly over the ankle, but without causing the occupant to move his or her feet from the rest position in order to alight from the chair. Conversely, when the occupant enters the chair, the occupant does not have to shift his or her feet as the chair is lowered to the rest position.

It will also be appreciated from FIG. 2 that the lift linkages and linear actuator are arranged so that the lifting force or thrust exerted by the linear actuator 19 is applied to the lift frame at a location intermediate pivot connector 46 of upper link 43 and pivot connection 49 of lower link 44. The same is true of course for links 36, 37 of the right side linkage if they were viewed form the left side of the chair. This arrangement of lift linkages and actuator maintains the linkages in tension which provides for greater strength and it also provides for greater stability and reduced stress on the pivots. Moreover, the center of gravity of the occupant and chair is shifted more directly over the connections of the lift linkages to the base (e.g. pivots 45, 48 in FIG. 2), rather than to increase the bending moment on the linkages which would result if the linkages were connected to the rear of the base. Further, the forward tilt of the chair in the raised position is facilitated by having the upper links substantially shorter than the lower links so that pivot 46 travels an arc defined by a shorter radius than the arc through which pivot 49 travels from the rest to the raised position.

Figure 4:
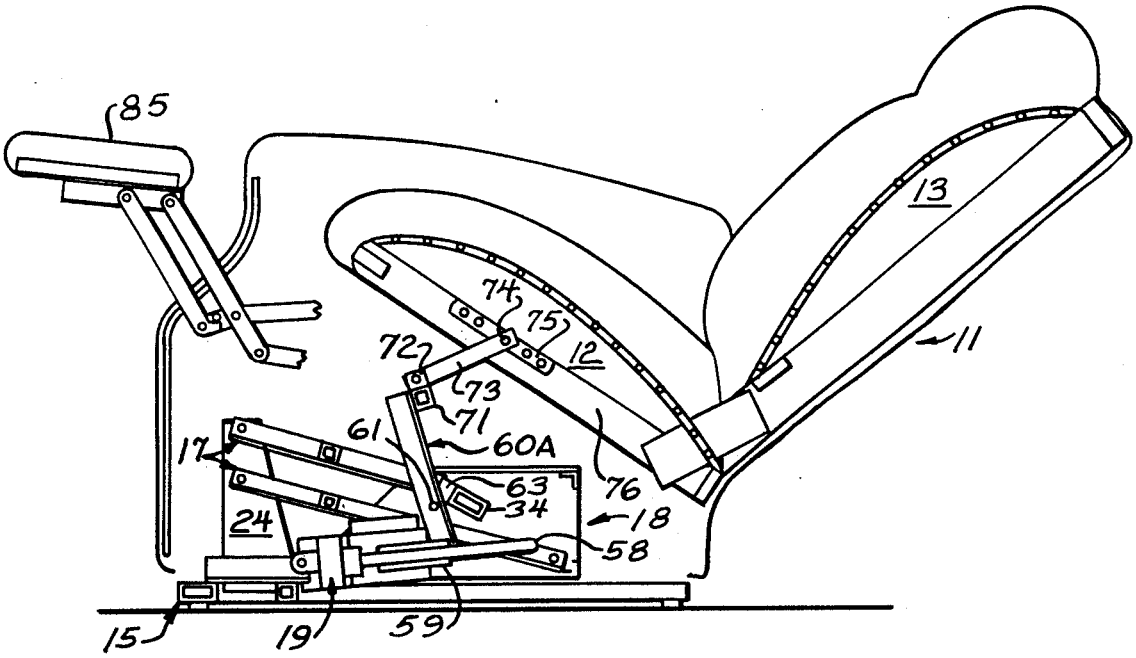
Figure 5:
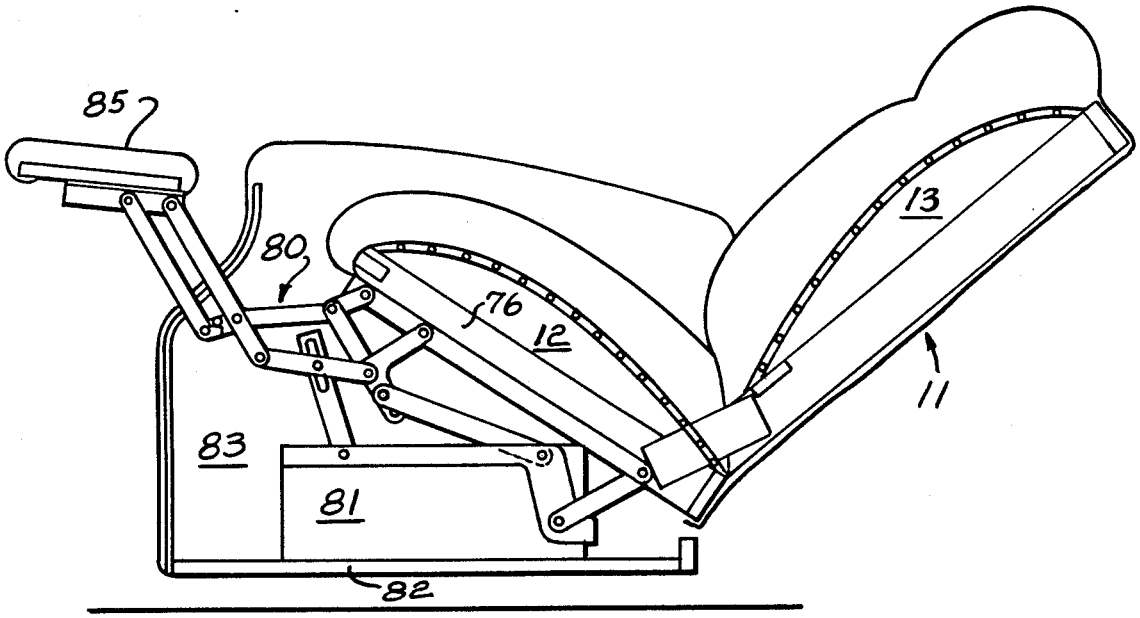

Turning now to the embodiment of FIGS. 4–6, many of the elements and subassemblies are the same as for the non-tilting embodiment of FIGS. 1–3, but the lift platform is modified to accommodate tilting the chair, and the chair is provided with an ottoman or leg rest together with a mechanism for actuating the leg rest. Thus, in the embodiment of FIGS. 4–6, the chair itself, including the seat and back may be the same, and identical reference numerals are used in the two embodiments to identify the same structures. Likewise, the base 15 is the same for each embodiment, the lift frame 18 is also the same and need not be described in further detail; and the left and right side lift linkages, 16, 17 are also the same. Similarly, the linear actuator 19 is the same in both embodiments as is the mounting of the linear actuator to the base 15 and to the lift frame 18.

Turning to FIG. 4, the bifurcated member 60 of FIG. 3 takes the form of a T-bar link having a base member 60A and a cross member 71 which is pivotally connected at 61 to a pair of mounting brackets, one of which is designated 63 and is welded to stringer 34. Base 60A of the T-bar link extends forwardly of the pivot 61 and cross member 71 extends transversely of the chair. The cross member 71 may be in the form of a tubular metal member, and it includes a depending ear at each side (see the ear 72 in FIG. 5) which is pivotally connected to drag link 73, the upper end of which is pivotally connected at 74 to a bracket 75 connected to the frame 76 of the seat 12 of the chair 11.

Turning now to FIG. 5, a pantograph linkage generally designated 80 is connected between the seat frame of the chair 11, and a side support frame 81 which is mounted to the base 82 of the right armrest 83 of a chair. The pantograph linkage 80 is conventional, and need not be described in further detail, other than to note that as the chair is moved rearwardly, the linkage 80 supports the chair relative to the base 81 (and a corresponding right side base, not shown) to both tilt the chair to the position of FIG. 6 (with the back 13 and seat 12 assuming the same relative position as in the normal rest position of FIG. 1), and to extend a leg rest generally designated 85 in FIGS. 4 and 5.

Returning now to FIG. 4, when the linear actuator is retracted relative to the normal lowered position of FIG. 1, so that the threaded nut 59 is forced more to the forward portion of the screw 58, the link 60A rotates clockwise about the pin 61 (as viewed from the left side and as seen in FIG. 5) to urge the chair rearwardly via links 73, 73A (FIG. 4) and the supporting pantograph linkage 80. When the actuator 19 is energized in the reverse direction, the link 60A will rotate counterclockwise about the pin 61, returning the chair to the normal use position of FIG. 1, and if it is rotated still further, the link 60A will engage the stringer 34 and cause the chair to be raised to the exit position similar to that shown and described above in connection with FIG. 2.

Having thus disclosed in detail two preferred embodiments of the invention, one a non-tilting embodiment and one in which the entire chair is tilted to the rear if desired, persons skilled in the art will be able to substitute equivalent structures for those illustrated and to modify other structures described while continuing to practice the principle of the invention; and it is, therefore, intended that all such modifications and substitutions be covered as they are embraced within the spirit and scope of the appended claims.

I claim:

1. An improved lift platform for moving a chair between a raised position and a lowered position comprising: a based adapted to rest on a support surface and having a front and a rear-corresponding respectively to the front and the rear of said chair; left and right stanchions secured to the left and right sides of the front of said base; a lift frame including left and right side frame sections; left and right side lift linkages pivotally connected at their forward ends respectively to said left and right stanchions and pivotally connected to their rear ends respectively to said left and right side frame sections of said lift frame, each lift linkage including an upper link and lower link forming a four-bar linkage with their associated stanchion and side frame section to tilt said lift frame downwardly and forwardly in the raised position, the upper link of each linkage being shorter than the associated lower link; and a linear actuator pivotally connected at one end to a forward portion of said base and pivotally connected at the other end to said lift frame adjacent a central rear portion thereof and characterized in that said left and right side lift linkages and said linear actuator are constructed and arranged such that the line of thrust of said linear actuator lies generally along a line, the extension of which, when viewed from the side, lies between the pivot connecting of said upper and lower links to said lift frame and thereby maintains said upper and lower links of said left and right side linkages in tension during movement between said raised and lowered positions.

2. The apparatus of claim 1, further characterized in that said upper and lower links of said lift linkages extend downwardly and rearwardly from their pivotal connections to said left and right side stanchions respectively in the lowered position, and said upper and lower links extend upwardly and rearwardly from said respective stanchions in the raised position whereby the front of the seat of said chair moves slightly forward from the lowered position to the raised position and the tilt of said chair places the center of gravity of the occupant more directly over the ankles of the occupant in the raised position without the occupant's having to move his or her feet in order to alight from the chair.

3. The apparatus of claim 2, further characterized in that said upper links of said left and right side lift linkages are substantially shorter than their associated lower links whereby said lift platform is tilted to a downward and forward disposition as the lift platform is raised while controlling the vertical movement of said lift platform from the lowered position to the raised position.

4. The apparatus of claim 1, further comprising a first cross-frame member rigidly interconnecting intermediate sections of the upper links of said left and right side lift linkages; and a second cross-frame member rigidly interconnecting said lower links at locations intermediate their respective ends, whereby said upper links are rigidly connected together and said lower links are rigidly connected together to provide greater lateral stability to said lift platform in the raised position.

5. The apparatus of claim 1, wherein said left and right side frame sections of said lift frame each comprise an inwardly turned upper flange, a vertical frame plate extending downwardly from said upper flange and providing pivotal connections to the rear ends of said upper and lower links of their associated side lift linkages, and a horizontal lift plate extending outwardly of the bottom of the associated vertical frame plate for mounting to a side of said chair respectively.

6. The apparatus of claim 1, wherein said linear actuator comprises an electric motor for rotating a screw member and an internally threaded nut received on said screw member, said apparatus further comprising means for mounting the distal end of said screw member of said linear actuator to said lift frame for pivotal action about a transverse horizontal axis near the center and rear portion of said lift frame.

7. The apparatus of claim 6, wherein said chair is further adapted to be placed in a reclining position from said lowered position, said lift frame further comprising an elongated link member pivotally connected to said chair at its forward end and pivotally connected to the distal end of said screw of said actuator at its rear end, said link member being further pivotally mounted to a transverse member mounted between said side frame section, said apparatus further including recliner linkage means interconnecting said chair and said lift frame and actuated by movement of said elongated link member being rotated as said linear actuator is actuated beyond said lowered position, whereby when said actuator is retracted after said seat is lowered, said elongated link member will actuate said linkage to tilt said chair rearwardly in the recline position.

* * * * *